US006382096B2

(12) United States Patent
Watanabe

(10) Patent No.: US 6,382,096 B2
(45) Date of Patent: May 7, 2002

(54) STENCIL SHEET RETAINING DEVICE

(75) Inventor: Hiroshi Watanabe, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/781,319

(22) Filed: Feb. 13, 2001

(30) Foreign Application Priority Data

Feb. 14, 2000 (JP) ..... 2000-035422

(51) Int. Cl.[7] ..... B41L 13/10; B41F 27/12
(52) U.S. Cl. ..... 101/128.1; 101/116; 101/415.1
(58) Field of Search ..... 101/116, 118, 101/128.1, 128.4, 129, 477, 415.1

(56) References Cited

U.S. PATENT DOCUMENTS 5,035,175 A 7/1991 Takita et al. ..... 101/116
5,575,204 A * 11/1996 Kawai et al. ..... 101/116
5,924,358 A * 7/1999 Motoe et al. ..... 101/116

* cited by examiner

*Primary Examiner*—Leslie J. Evanisko
(74) *Attorney, Agent, or Firm*—Sughrue Mion, PLLC

(57) ABSTRACT

A stencil sheet retaining device includes a clamping plate (44) for retaining an end portion of the stencil sheet (M), and a flapper member (49) for drawing out the end portion of the stencil sheet (M) from the clamping plate (44) side. A first contact piece (48) attached to the clamping plate (44) and a second contact piece (51) attached to the flapper member (49) are pressed due to the profiles of the cam grooves (56*a*, 56*b*) of a movable cam member (56) according to the rotary position of the rotary cylindrical drum (6), so that the clamping plate (44) and the flapper member (49) can be opened and the open angle of the clamping plate (44) and the flapper member (49) can be adjusted.

4 Claims, 12 Drawing Sheets

STENCIL SHEET RETAINING DEVICE

BACKGROUND OF THE INVENTION

1. Field of the Invention

The present invention relates to a stencil sheet retaining device for retaining a portion of a stencil sheet at a rotary cylindrical drum so that the stencil sheet, which has already been subjected to a stencil-making process, can be wound around the rotary cylindrical drum in a rotary type stencil printing machine.

The present application is based on Japanese Patent Application No. 2000-035422, which is incorporated herein by reference.

2. Description of the Related Art

In general, the rotary type stencil printing machine has a rotary cylindrical drum capable of rotating around its own axis. A stencil sheet, which has been subjected to a stencil-making process in a stencil making section, is wound on an outer circumferential surface of the rotary cylindrical drum. Inside the rotary cylindrical drum, there is provided an ink supplying device for supplying ink in such a manner that the ink is made to pass through the outer circumferential surface of the rotary cylindrical drum. A pressing type stencil printing is conducted when a printing sheet is supplied to between the rotary cylindrical drum and a roller which comes into contact with the outer circumferential surface of the rotary cylindrical drum. In the stencil printing machine of the aforementioned type, there is provided a stencil sheet retaining device for holding an end portion of a stencil sheet at the rotary cylindrical drum in such a manner that the stencil sheet, which has already been subjected to a stencil-making process, is wound on the rotary cylindrical drum.

A related stencil sheet retaining device is so constructed that a forward end portion of a stencil sheet, which has already been subjected to a stencil-making process and conveyed, can be held by the stencil sheet retaining device. Specifically, the forward end portion of the stencil sheet is held between a magnet plate and a clamping plate made of magnetic material. That is, there is provided an opening and closing mechanism for opening and closing the clamping plate between an attracting position at which the clamping plate, which can be freely opened and closed, is attracted by the magnet plate and a separating position at which the clamping plate is separated from the magnet plate.

The opening and closing mechanism mainly includes a first and a second opening and closing mechanism which will be described as follows.

In the first opening and closing mechanism, an opening and closing angle from an attracting position of the clamping plate to a separating position is approximately 180°, and the clamping plate is attracted by another magnet plate even at the separating position. At one end of the rotary fulcrum of the clamping plate, there is provided a driven gear. This driven gear is meshed with a drive gear which is moved by a moving device such as a motor or solenoid. When the drive gear meshed with the driven gear is rotated by the drive device such as a motor, the clamping plate can be opened and closed by the rotation of the rotary fulcrum through the driven gear.

In the first opening and closing mechanism, there is provided a protruding type protrusion formed at one end of the rotary fulcrum of the clamping plate. This protruding type protrusion is engaged with a recess type protrusion moved by a moving device such as a motor or solenoid. When the recess type protrusion engaged with the protruding type protrusion is rotated by the drive device such as a motor, the rotary fulcrum is rotated through the protruding type protrusion, so that the clamping plate can be opened and closed.

By the second opening and closing mechanism, the clamping plate is formed like a lever. The clamping plate is usually attracted by the magnet plate (at the attracting position). An operating piece, which is moved by a moving device such as a motor or solenoid, comes into contact with a point of action of the leverage. When the operating piece pushes the point of action of leverage, the clamping plate is put into an open state (at the separate position).

The second opening and closing mechanism has a flapper member, which is opened and closed in the same manner as the clamping plate, at the front portion of the opening and closing end of the clamping plate. The flapper member is also formed like a lever and usually attracted by another magnet plate so that the flapper member is put into closed state. An operating piece, which is moved by the moving device such as a motor or solenoid in a predetermined timed relation, comes into contact with a point of action of the leverage. When the operating piece pushes the point of action of leverage, the flapper member is put into an open state. This flapper member is put into an open state only when the stencil sheet is discharged. Due to the foregoing, when the stencil sheet is set on the rotary cylindrical drum, it is located on an upper side of the flapper member. When the stencil sheet is discharged, the flapper member is put into an open state together with the clamping plate. Therefore, an end portion of the stencil sheet, which is interposed between the clamping plate and the magnet plate, is made to flap from between the clamping plate and the magnet plate, so that the end portion of the stencil sheet can be released.

However, in the above stencil sheet retaining device, the following problems may be encountered. In the first and the second opening and closing mechanism, when a stencil sheet is discharged from and set onto the rotary cylindrical drum, the rotation of the rotary cylindrical drum is once stopped at a predetermined position, and then the clamping plate (and the flapper member) is opened and closed. Therefore, it takes time to discharge the stencil sheet from the rotary cylindrical drum and set the stencil sheet onto the rotary cylindrical drum. Accordingly, it is difficult to reduce a period of time from a stencil-making process to a printing process for obtaining the first printed matter.

As described above, in the first and the second opening and closing mechanism, when the clamping plate (and the flapper member) is opened and closed, the rotary cylindrical drum must be once stopped. That is, when the rotary cylindrical drum is rotated for discharging a stencil sheet, the clamping plate stops holding the stencil sheet and only causes an end portion of the stencil sheet to be free. Therefore, in the related manner, a separation pawl is arranged in the stencil discharging section, so that the free end portion of the stencil sheet can be guided and separated from the rotary cylindrical drum. It is preferable that this separating pawl is located close to the rotary cylindrical drum. However, since the stencil sheet retaining device is arranged, a limit is set when the separating pawl is made to come close to the rotary cylindrical drum. For the above reasons, there is a possibility of the occurrence of failure when the stencil sheet is delivered to the stencil discharging section.

In the first and the second opening and closing mechanism, the clamping plate (and the flapper member) is separated from the magnet plate by a drive force of a motor or solenoid. However, in order to positively hold the stencil sheet, an attraction force of the magnet plate must be sufficiently strong. Therefore, the motor or solenoid, which opens and closes the clamping plate while resisting the strong attraction force, is given a heavy load.

Further, the capacity of the motor or solenoid must be large so that the motor or solenoid can endure the above heavy load. Accordingly, the dimension of the stencil sheet retaining device itself is extended, and the dimension of the entire stencil printing machine is extended. In the first opening and closing mechanism, in order to open and close the clamping plate, it is necessary to provide two driving sources of the moving device and the drive device. Therefore, it is impossible to reduce the dimension of the stencil sheet retaining device and the dimension of the stencil printing machine.

In the first opening and closing mechanism, the following problems may be encountered. Since the opening and closing angle of the clamping plate is large, there is a possibility that an end portion of the stencil sheet, which has been conveyed, is held being bent when it is set onto the rotary cylindrical drum. Due to the foregoing, wrinkles may be caused on the stencil sheet which has been set onto the rotary cylindrical drum, and further the stencil sheet is skewed when it is set onto the rotary cylindrical drum.

SUMMARY OF THE INVENTION

In order to solve the above problems, it is an object of the present invention to provide a stencil sheet retaining device, in which a period of time from formation of a stencil sheet to printing can be reduced; a motion of setting the stencil sheet onto the rotary cylindrical drum and discharging the stencil sheet can be stabilized; and a load, which is given to the clamping plate at the time opening and closing the clamping plate, can be reduced.

To achieve the above object, according to the first aspect of the present invention, there is provided a stencil sheet retaining device for holding an end portion of a stencil sheet so that the stencil sheet, which has already been subjected to a stencil-making process, is wound on an outer circumferential surface of a rotary cylindrical drum rotating around own axis thereof. The stencil sheet retaining device comprises: a clamping plate pivotally disposed through a first rotary shaft arranged in parallel with the axis of the rotary cylindrical drum with respect to the outer circumferential surface of the rotary cylindrical drum, the clamping plate having an oscillating end portion which is attracted by a magnet plate arranged at a predetermined position on the outer circumferential surface side of the rotary cylindrical drum so as to hold the end portion of the stencil sheet between the clamping plate and the magnet plate; a flapper member pivotally disposed through a second rotary shaft arranged in parallel with the first rotary shaft with respect to the outer circumferential surface of the rotary cylindrical drum, the flapper member has an oscillating end portion, wherein the end portion of the stencil sheet held by the clamping plate can be located on an upper side on which the oscillating end portion of the flapper member is attracted to the magnet plate; a first contact piece disposed through the first rotary support shaft at an end portion of the clamping plate opposite to the oscillating end portion of the clamping plate; a second contact piece disposed through the second support shaft at an end portion of the flapper member opposite to the oscillating end portion of the flapper member; a cam member having cam grooves movably arranged at a position where the cam member can be contacted with and separated from the first and second contact members, the cam member coming into contact with and pressing the first and the second contact member according to a rotary position of the rotary cylindrical drum, so that the clamping plate and the flapper member can be put into open states in which the clamping plate and the flapper member can be respectively separated from the magnet plate, and so that the open states, in which the clamping plate and the flapper member are respectively open, can be respectively set at a predetermined timed relation and open angle; and a driving device which moves the cam member to positions at which the cam member is contacted with and separated from the first and second contact pieces.

Further, according to the second aspect of the present invention, it is preferable that the flapper member is opened in accordance with rotation of the rotary cylindrical drum due to profiles of the cam grooves of the cam member so as to adjust an open angle of the flapper member, and wherein an end portion of the stencil sheet is drawn out from the clamping plate side which is put into an open state, and the stencil sheet is delivered to a stencil discharging section for discharging the stencil sheet by lifting up the end portion of the stencil sheet so that the end portion of the stencil sheet can be separated from the outer circumferential surface of the rotary cylindrical drum.

Furthermore, according to the third aspect of the present invention, it is preferable that the clamping plate is opened in accordance with rotation of the rotary cylindrical drum due to profiles of the cam grooves of the cam member so as to adjust an open angle of the clamping plate, and wherein an end portion of the stencil sheet conveyed from a stencil making section for making the stencil sheet is guided between the clamping plate and an upper surface of the flapper member.

DETAILED DESCRIPTION OF THE PREFERRED EMBODIMENT

A preferred embodiment of the present invention now will be described in detail with reference to FIGS. 1 to 12.

Figure 1:
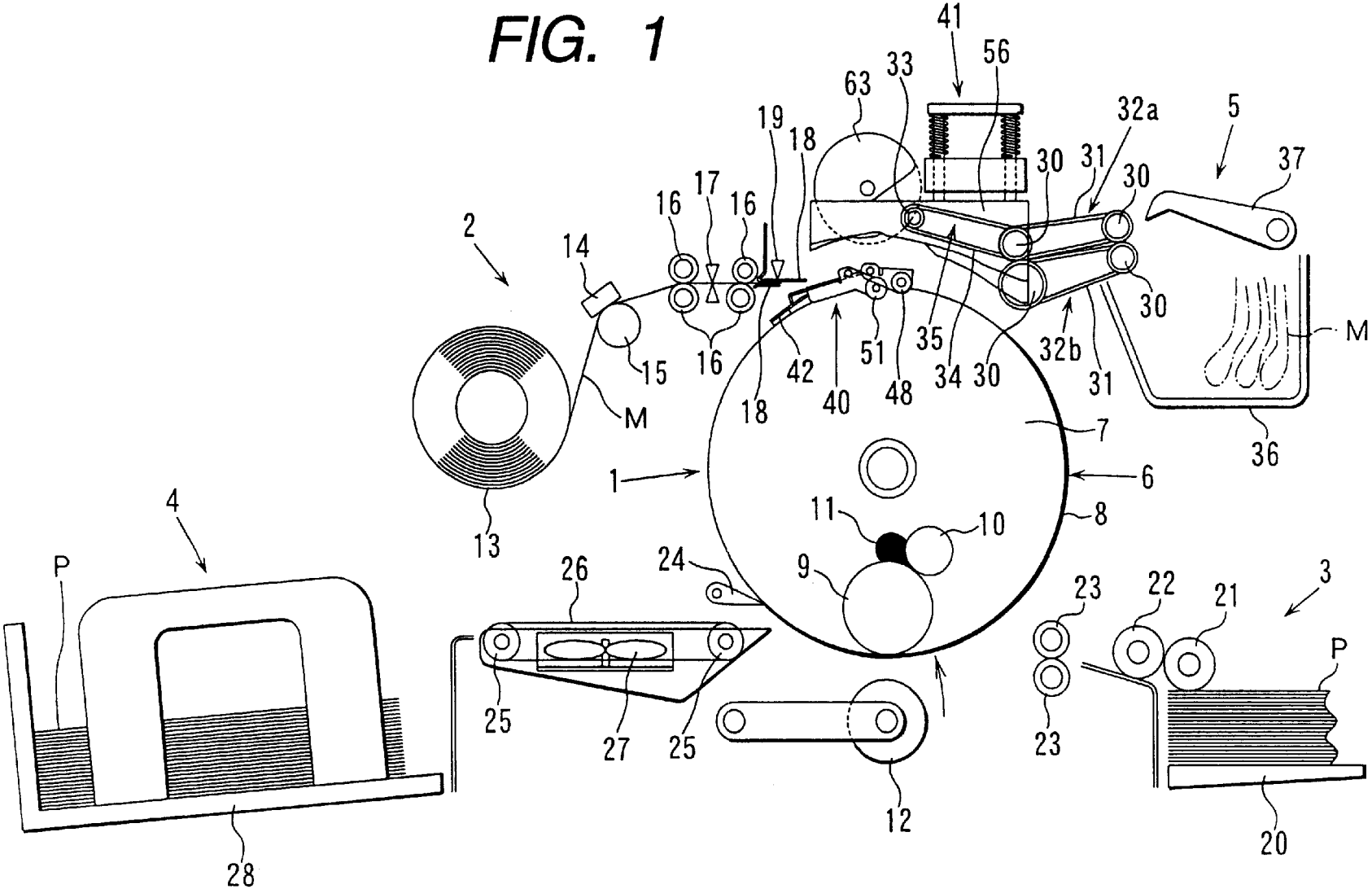
FIG. 1 is a side view showing an example of a stencil printing machine in which a stencil sheet retaining device of the present invention is adopted.

As shown in FIG. 1, a stencil printing machine, in which a stencil sheet retaining device of the present invention is adopted, includes: a printing section 1, a stencil making section 2, a sheet supplying section 3, a sheet discharging section 4, and a stencil discharging section 5.

In the printing section 1, there is provided a rotary cylindrical drum 6. The rotary cylindrical drum 6 includes: two disk-shaped side plates 7 arranged on both sides; and a cylindrical circumferential wall 8, arranged on the outer circumferential walls of the side plates 7, wherein ink is capable of passing through this circumferential wall 8. This rotary cylindrical drum 6 is pivotally supported by a frame (not shown) of the stencil printing machine so that the rotary cylindrical drum 6 can rotate around the central axis of its own.

In the outer circumferential sections of the two side plates 7, there are provided gear sections (not shown) which are used for driving the rotary cylindrical drum, and these gear sections are meshed with drive gears connected with a motor for driving the rotary cylindrical drum. The rotary cylindrical drum 6 is rotated clockwise in FIG. 1 by a drive motor therefor.

In the rotary cylindrical drum 6, there is provided an ink supplying device for supplying ink onto the inner circumferential surface of the circumferential wall 8. The ink supplying device mainly includes a squeeze roller 9 arranged in parallel with the axis of the rotary drum 6, and a doctor roller 10. The squeeze roller 9 is pivotally supported while it is slidably coming into contact with the inner circumferential surface of the circumferential wall 8. The doctor roller 10 is arranged leaving a minute interval between the doctor roller 10 and the squeeze roller 9. There is provided an ink pool 11, in which ink supplied from an ink source (not shown) is formed into a wedge-shape, between the doctor roller 10 and the squeeze roller 9. When the squeeze roller 9 is rotated clockwise in FIG. 1, ink is sent from the ink pool 11 to the minute interval and supplied onto the inner circumferential surface of the circumferential wall 8 while a quantity of ink is being measured.

At a lower position of the rotary cylindrical drum 6, there is provided a press roller 12 which is a pressing mechanism for pressing a printing sheet P against the rotary cylindrical drum 6. The press roller 12 is capable of coming into contact with and separating from the outer circumferential surface of the rotary cylindrical drum 6 (circumferential wall 8). Except for the press roller 12, the pressing mechanism includes a pressure drum, the diameter of which is the same as that of the rotary cylindrical drum 6, and the pressure drum rotates coming into contact with the outer circumferential surface of the rotary cylindrical drum 6 (circumferential wall 8) under the condition that the printing sheet P is wound around the pressure drum.

In a portion of the outer circumferential surface of the rotary cylindrical drum 6, there is provided a stencil sheet retaining device of the present invention. Although the structure of the stencil sheet retaining device is described in detail later, the stencil sheet retaining device retains an end portion of a stencil sheet M, which is formed by the stencil making section 2, at a portion on the outer circumferential surface of the rotary cylindrical drum 6. Then, when the rotary cylindrical drum 6 is rotated, the stencil sheet M is wound on the outer circumferential surface of the rotary cylindrical drum 6.

The stencil making section 2 includes: a stencil roll section 13 in which a thermographic stencil sheet M, which is a continuous sheet, is formed into a roll and stored; a thermal head 14 comprised of a plurality of dot-shaped heating elements which are arranged in a single line in the traverse direction; a platen roller 15 opposed to the thermal head 14; a stencil feeding roller 16; and a stencil cutter 17.

In the stencil making section 2, a stencil sheet M, which has been drawn out from the stencil sheet roll section 13, is interposed between the thermal head 14 and the platen roller 15 and sent out when the platen roller 15 is rotated. Into the thermal head 14, an image information signal on an image of an original, which has been read out by a reading device (not shown), is input. In accordance with the image information signal, the thermal head 14 selectively heats the respective dot-shaped heating elements, so that the stencil sheet M is subjected to a thermographic stencil-making process, to thereby form a desired perforated image formed of a plurality of fine through holes in the stencil sheet M in a dot matrix manner. The thus-formed stencil sheet M is fed to the rotary cylindrical drum 6 by the stencil feeding roller 16. The stencil sheet M is cut with the stencil cutter 17 by one portion of printing. At a position where the stencil sheet M is delivered to the rotary cylindrical drum 6, there are provided upper and lower guides 18 for guiding a forward end portion of the stencil sheet M. At a delivery position of the stencil sheet M relating to the upper and lower guide plates 18, there is provided a stencil detecting device 19 such as a light beam sensor for detecting the forward end portion of the stencil sheet M.

Next, the sheet supplying section 3 has a sheet supplying tray 20 on which printing sheets P are stacked. The printing sheets P stacked on the sheet supplying tray 20 are taken out one by one by the sheet supplying roller 21 and the sheet separating roller 22. The thus-taken printing sheet P is conveyed to a nip section of a pair of timing rollers 23. The pair of timing rollers 23 feed the printing sheet P to between the rotary cylindrical drum 6 and the press roller 12 in a predetermined timed relation.

The printing sheet P, which has been fed to between the rotary cylindrical drum 6 and the press roller 12, is pressed against the stencil sheet M wound around the rotary cylindrical drum 6 when the press roller 12 is raised. When ink flowing from the inside of the rotary cylindrical drum 6 through the outer circumferential surface of the circumferential wall 8 passes through the thermographic perforated portion formed on the stencil sheet M, an image is transferred onto the printing sheet P. In this way, the printing is conducted.

Next, the sheet discharging section 4 is arranged at a position to which a printing sheet P, which has already been printed, is fed from between the rotary cylindrical drum 6 and the press roller 12. The sheet discharging section 4 includes a separating pawl 24 for separating the printing sheet P, which has already been printed, from the rotary cylindrical drum 6. The printing sheet P, which has been separated from the rotary cylindrical drum 6 by the separating pawl 24, is conveyed outside the stencil printing machine by a conveying system. The conveying system is constructed in such a manner that an endless belt 26 is stretched between a pair of rollers 25, and the printing sheet P is conveyed when the belt is rotated by the rollers 25. The conveying system includes a suction fan 27 for sucking and holding the printing sheet P to be conveyed with respect to the belt 26. The printing sheet P conveyed outside the stencil printing machine by the conveying system is fed onto a sheet discharging stand 28 and stacked on it.

Next, the stencil discharging section 5 receives an end portion of the stencil sheet M, which has already been used for printing and released from the stencil sheet retaining device, and conveys the stencil sheet M. Therefore, the stencil discharging section 5 includes an upper conveying section 32*a* and a lower conveying section 32*b* in which an endless belt 31 is stretched between a pair of rollers 30. In the upper conveying section 32*a*, there is provided a delivery section 35 constructed in such a manner that an endless belt 34 is stretched between the roller 30 and the roller 33 arranged on an upper side of the rotary cylindrical drum 6. The upper 32*a* and the lower conveying section 32*b* and the delivery section 35 are driven by the same drive source (drive motor). The upper 32*a* and the lower conveying section 32*b* rotate so that the stencil sheet M can be drawn into between them, and the delivery section 35 rotates so that the stencil sheet M located on the lower side can be guided into between the upper 32*a* and the lower conveying section 32*b*. Due to the foregoing, the stencil discharging section 5 guides an end portion of the stencil sheet M, which has already been used for printing and released from the stencil sheet retaining device, into between the upper 32*a* and the lower conveying section 32*b* at the delivery section 35 and transfers it to the delivery section 35. At the rear stage of the upper 32*a* and the lower conveying section 32*b*, there are provided a stencil discharged container 36 in which the stencil sheet M is stored and a compressing plate 37 for compressing the thus stored stencil sheet M in the stencil discharged container 36. The stencil discharged container 36 is detached from the stencil printing machine, and the stencil sheet M which has already been used for printing and stored in the stencil discharged container 36 is scrapped.

The stencil sheet retaining device of the present invention will be explained as follows referring to FIGS. 2 to 5.

Figure 2:
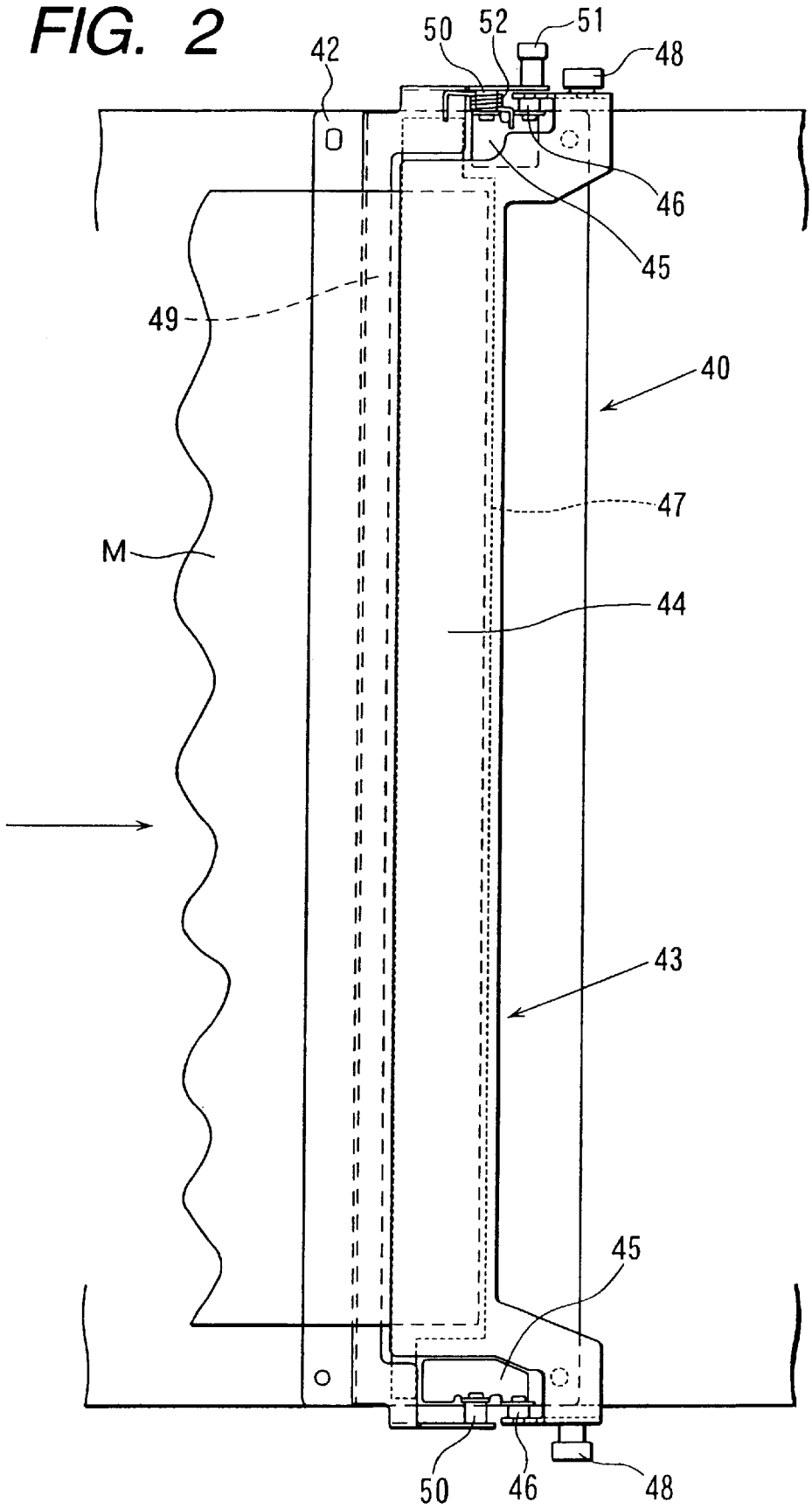
FIG. 2 is a plan view showing a retaining section of the stencil sheet retaining device.
Figure 3A:
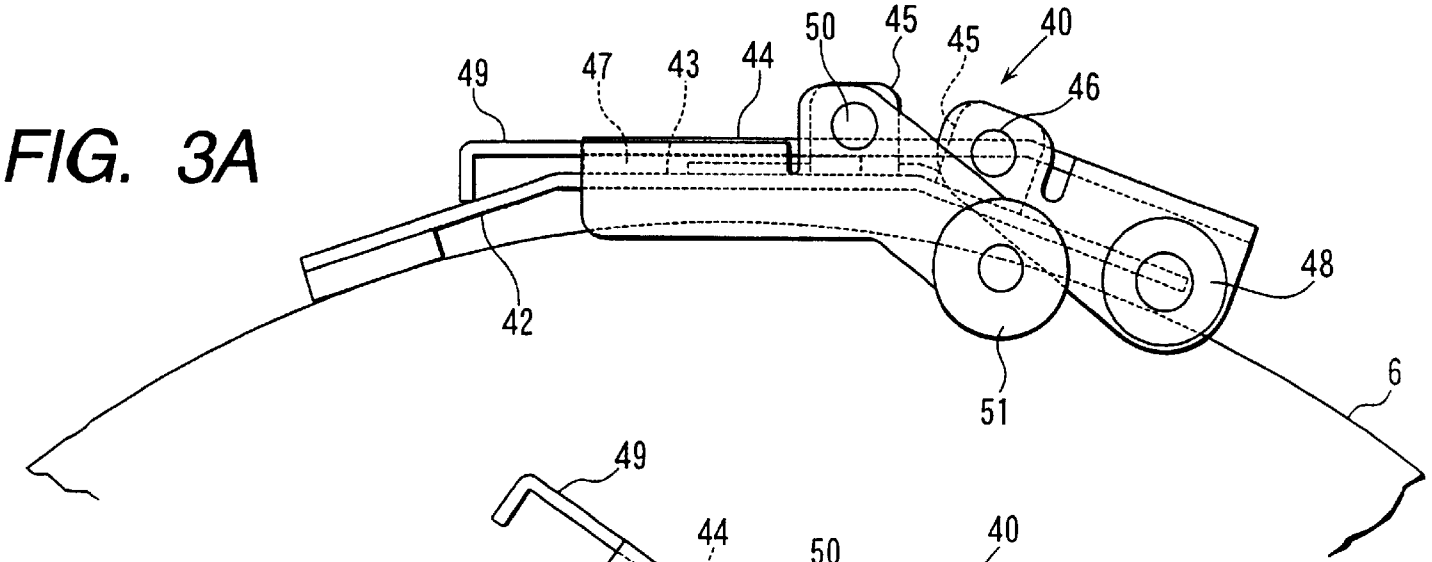
FIG. 3A is a side view showing a motion of the stencil sheet retaining device.
Figure 3B:
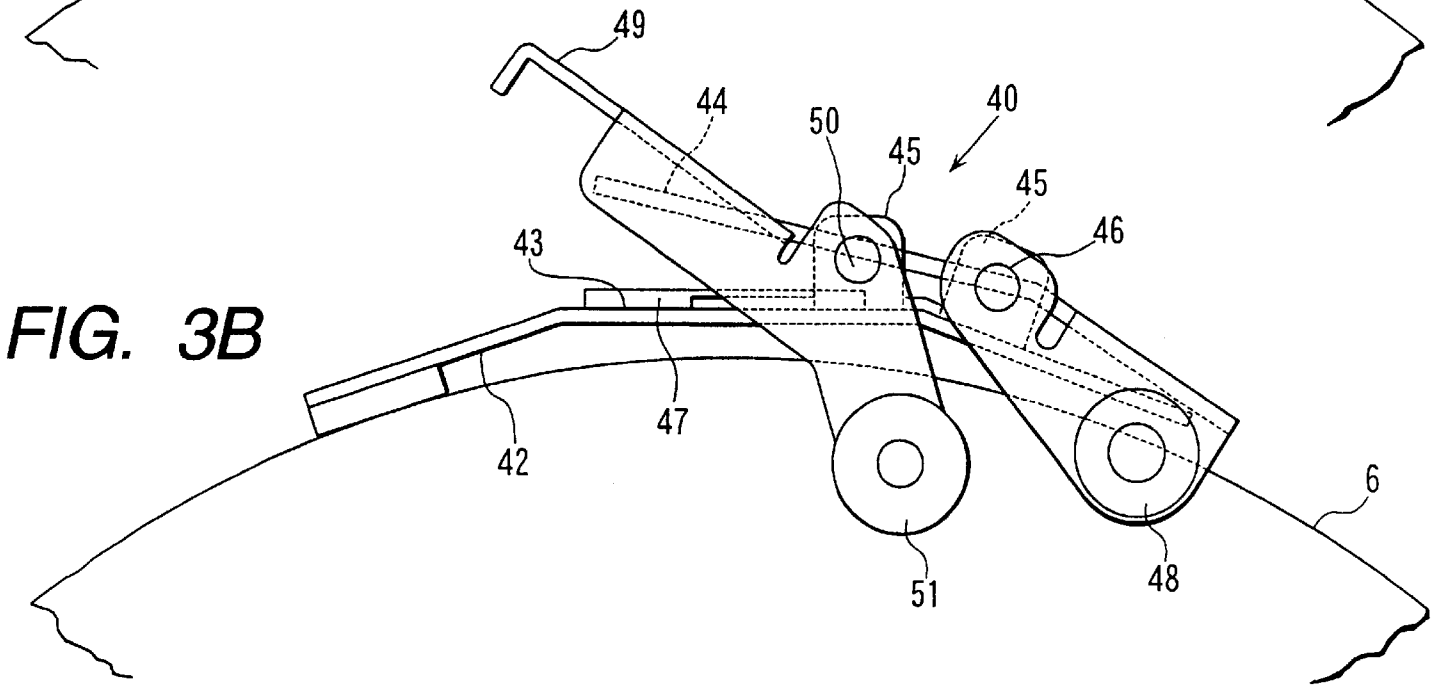
FIG. 3B is a side view showing a motion of the stencil sheet retaining device.
Figure 4:
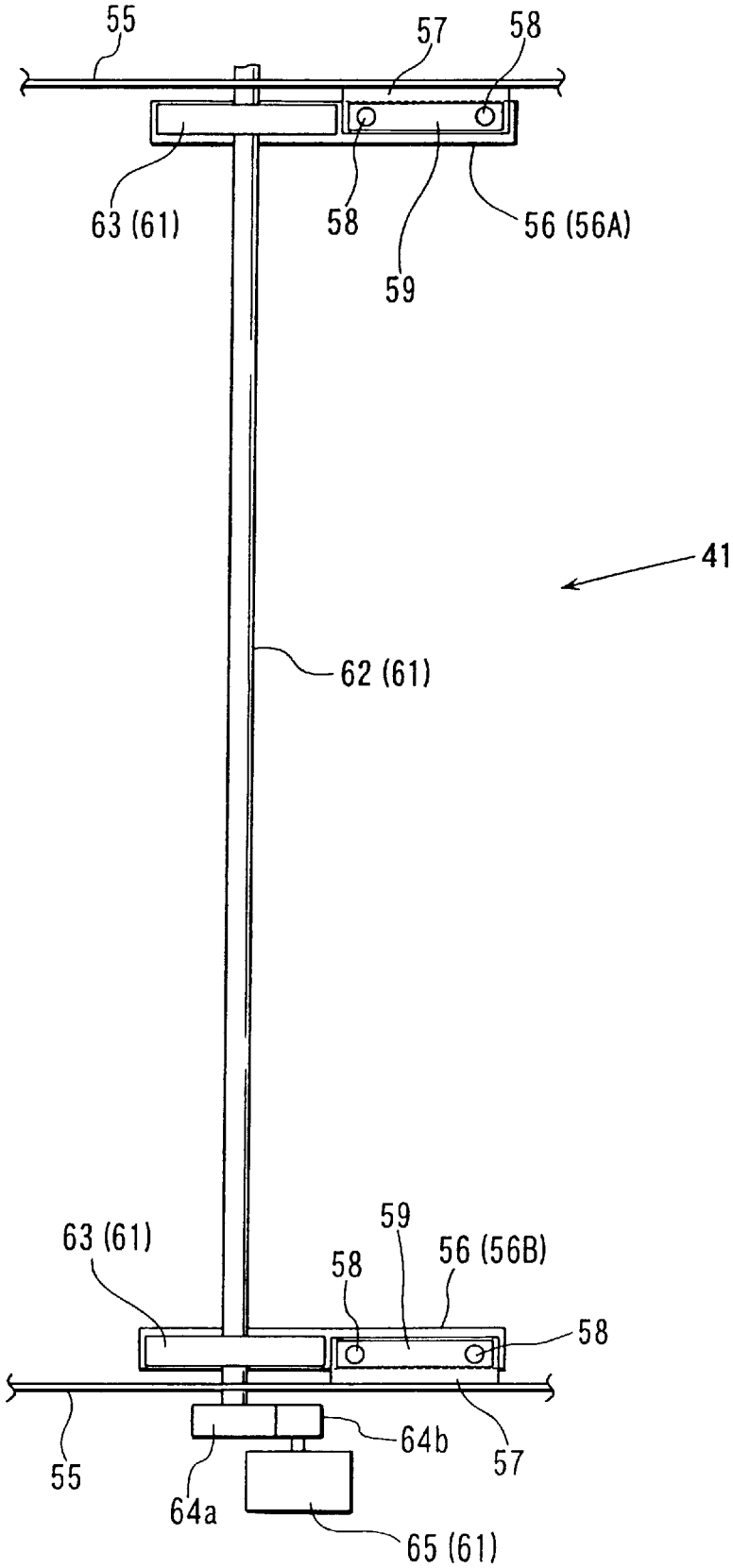
FIG. 4 is a plan view showing a drive section of the stencil sheet retaining device.
Figure 5:
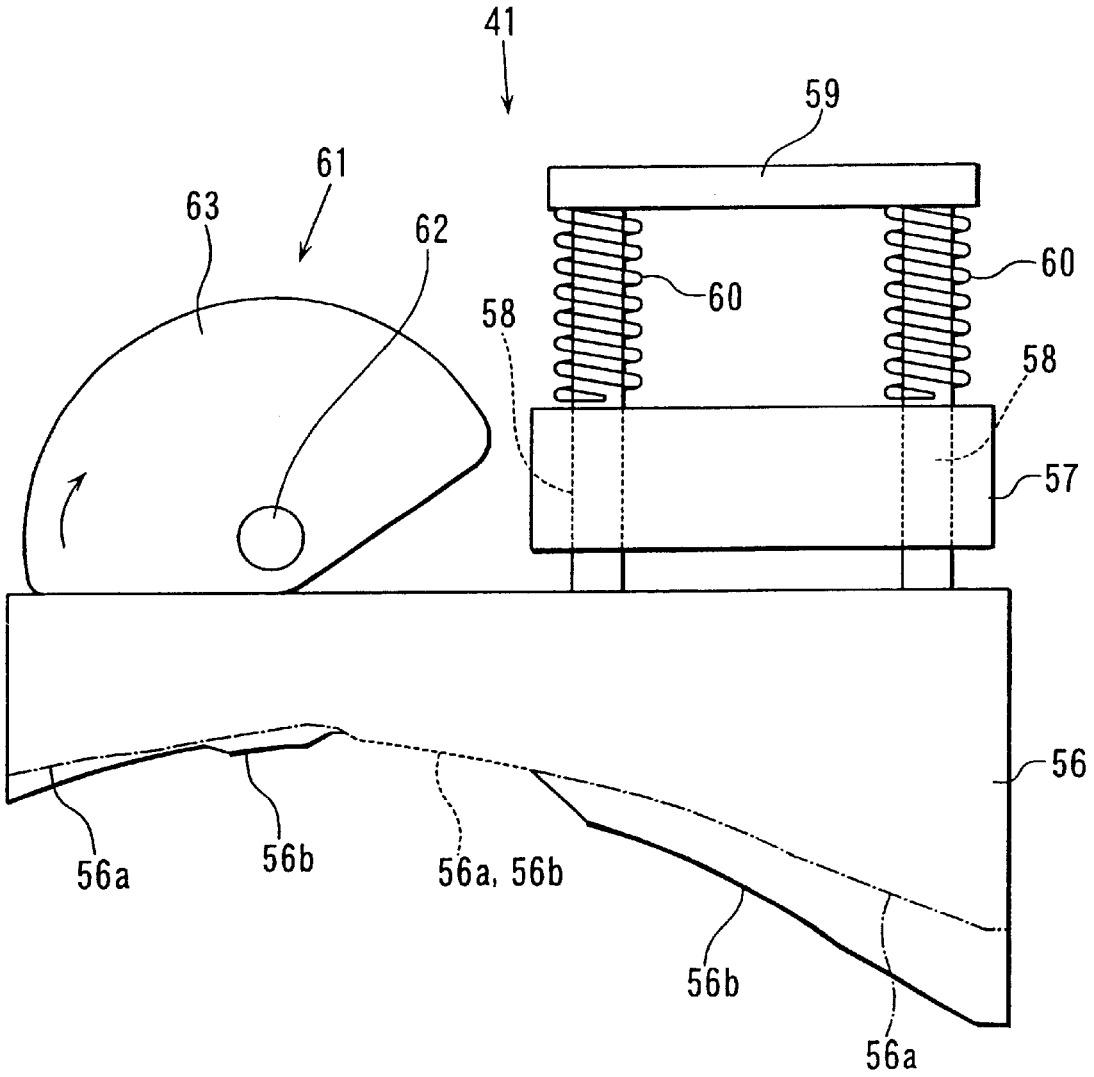
FIG. 5 is a side view showing the drive section.

FIG. 2 is a plan view showing a retaining section of the stencil sheet retaining device of the present invention. FIGS. 3A and 3B are side views showing a motion of the retaining section of the stencil sheet retaining device. FIG. 4 is a plan view showing a drive section of the stencil sheet retaining device. FIG. 5 is a side view showing the drive section of the stencil sheet retaining device.

As described before, in order to wind the stencil sheet M, which has been formed in the stencil making section 2, around the outer circumferential surface of the rotary cylindrical drum 6, the stencil sheet retaining device retains an end portion of the stencil sheet M which has been conveyed to a position close to the rotary cylindrical drum 6. This stencil sheet retaining device includes: a retaining section 40 arranged on the outer circumferential surface of the rotary cylindrical drum 6; and a drive section 41, which serves as a driving device, arranged at a predetermined position around the rotary cylindrical drum 6.

First, the retaining section 40 will be explained below.

In a fixed portion of the rotary cylindrical drum 6 on the outer circumferential surface side, at both end portions of the circumferential wall 8 which is wound around the side plates 7, there is provided a rigid, stencil mounting base 42 which is longitudinally arranged in the axial direction of the rotary cylindrical drum 6 in such a manner that both the side plates 7 are connected with each other by the stencil mounting base 42. An upper surface 43 of this stencil mounting base 42 is flat.

On the upper surface 43 of this stencil mounting base 42, there is provided a clamping plate 44. The clamping plate 44 is comprised of a base portion made of a rectangular metal plate which is arranged in parallel with the axial line of the rotary cylindrical drum 6. The clamping plate 44 is pivotally attached to the support shaft sections 45 fixed to both end portions of the stencil mounting base 42 in the longitudinal direction in such a manner that the clamping plate 44 can be rotated through the first rotary support shaft 46 arranged in parallel with the axial line of the rotary cylindrical drum 6. Due to the above structure, the clamping plate 44 can be oscillated in the rotary direction of the rotary cylindrical drum 6 directed by the arrow in FIG. 2. Therefore, as shown in FIGS. 3A and 3B, the clamping plate 44 can be oscillated in such a manner that the inside of the clamping plate 44 faces an upper surface 43 of the stencil mounting base 42 and comes into contact with and separates from the upper surface 43.

On the upper surface 43 of the stencil mounting base 42, there is provided a magnet plate 47. That is, as shown in FIG. 3A, when the clamping plate 44 made of a metal sheet is oscillated toward the upper surface 43 of the stencil mounting base 42, the inside of the clamping plate 44 is attracted by the magnet plate 47 and put into a closed condition. As shown in FIG. 2, under the closed condition in which the inside of the clamping plate 44 is attracted by the magnet plate 47, an end portion of the stencil sheet M is interposed between the clamping plate 44 and the magnet plate 47.

At both end portions of the clamping plate 44 in the longitudinal direction which are opposed to the oscillating end portion with respect to the first rotary support shaft 46, the first contact pieces 48 are arranged. As shown FIG. 2, the first contact pieces 48 protrude outside the side plate 7 in parallel with the axial line of the rotary cylindrical drum 6. As described above, the clamping plate 44 is constructed like a seesaw in such a manner that the oscillating end side, which is attracted by the magnet plate 47, and the other end side, to which the first contact pieces 48 are attached, are arranged through the first support shaft 46. As shown in FIG. 3A, when the oscillating end side is attracted by the magnet plate 47, the other end side to which the first contact pieces 48 are attached is oscillated in such a manner that the other end side is separated from the stencil mounting base 42.

On an upper surface 43 of the stencil mounting base 42, there is provided a flapper member 49. The flapper member 49 is comprised of a rectangular metal plate, the longitudinal direction of which is parallel with the axial line of the rotary cylindrical drum 6, in such a manner that the flapper member 49 surrounds the rectangular portion of the clamping plate 44. Both end portions of the flapper member 49 in the longitudinal direction are pivotally attached to the support shaft section 45, which is fixed to both end portions of the stencil mounting base 42 in the longitudinal direction, through the second rotary support shaft 50 which is parallel with the axial line of the rotary cylindrical drum 6. Due to the foregoing structure, the flapper member 49 can be oscillated in the rotary direction of the rotary cylindrical drum 6 shown by the arrow in FIG. 2 differently from the clamping plate 44. Therefore, as shown in FIGS. 3A and 3B, the flapper member 49 is oscillated in such a manner that the inside of the flapper member 49 faces the upper surface 43 of the stencil mounting base 42 and comes into contact with and separates from the upper surface 43 of the stencil mounting base 42. That is, the flapper member 49 has its own oscillating end portion on the front side of the oscillating end portion of the clamping plate 44, so that the flapper member 49 can independently oscillate from the clamping plate 44.

As shown in FIG. 3A, when the flapper member 49 comprised of a metal plate is oscillated toward the upper surface 43 of the stencil mounting base 42, the inside of the flapper member 49 is attracted by the magnet plate 47, that is, the flapper member 49 is put into a closed condition. As shown in FIG. 3A, the oscillating end portion of the flapper member 49 is bent downward. Therefore, in the closed condition, the oscillating end portion of the flapper member 49 comes into contact with the stencil mounting base 42 side. Then, as shown in FIG. 2, the flapper member 49 causes an end portion of the stencil sheet M to locate on its upper side under the closed condition in which the flapper member 49 is attracted by the magnet plate 47. That is, the flapper member 49 is attracted by the magnet plate 47 and arranged on the reverse side of the end portion of the stencil sheet M.

On the side of one end portion of the flapper member 49 in the longitudinal direction which is opposed to the oscillating end with respect to the second support shaft 50, the second contact piece 51 is arranged. As shown in FIG. 2, the second contact piece 51 is protruded outside the side plate 7 in parallel with the axial line of the rotary cylindrical drum 6. As described above, the flapper member 49 is constructed like a seesaw in such a manner that the side of oscillating end attracted by the magnet plate 47 and the side of the end portion in which the second contact piece 51 are arranged are opposed to each other with respect to the second rotary support shaft 50. As shown in FIG. 3A, when the side of the oscillating end is attracted by the magnet plate 47, the side of the end portion in which the second contact piece 51 are arranged is oscillated in such a manner that the side of the end portion is separated from the stencil mounting base 42.

At one end of the second rotary support shaft 50 on which the flapper member 49 is mounted, there is provided a twist coil spring 52 which is an urging member. One end of this twist coil spring 52 comes into contact with the support shaft 45, and the other end of this twist coil spring 52 comes into contact with the outside of the flapper member 49. An urging force of the twist coil spring 52 acts onto the support shaft 45 side and the flapper member 49 side. Due to the foregoing structure, the twist coil spring 52 urges the flapper member 49 at all times in a direction in which the flapper member 49 is attracted by the magnet plate 47. In this connection, the twist coil spring 52 may be provided at both end portions of the second rotary support shaft 50. The urging member is not limited to the twist coil spring 52, but it is possible to use a leaf spring or others capable of giving a resilient urging force.

Next, the drive section 41 will be explained below.

The drive section 41 is provided for oscillating the clamping plate 44 and the flapper member 49, which are moved according to the rotation of the rotary cylindrical drum 6, at a predetermined position in a predetermined times relation. The drive section 41 is attached to the support plate 55 which is fixed to the stencil printing machine as shown in FIG. 4. The above predetermined position is a position at which the clamping plate 44 and the flapper member 49 reach an upper position (close to the stencil making section 2 and the stencil discharging section 5) when the rotary cylindrical drum 6 is rotated as shown in FIG. 1.

The support plates 55 are vertically arranged perpendicular to the axial line of the rotary cylindrical drum 6 in such a manner that each support plate 55 faces each side plate 7 and that the rotary cylindrical drum 6 is interposed between the support plates 55. A cam member 56 is attached to each support plate 55. As shown in FIGS. 4 and 5, the cam member 56 is attached to the support block 57 which is fixed to the support plate 55. From the cam member 56, a pair of support shafts 58, which penetrate the support block 57, are protruded upward. Due to the above structure, the cam member 56 can be slidably moved with respect to the fixed support block 57 through the support shafts 58 in a direction (vertical direction) in which the cam member 56 is contacted with and separated from the rotary cylindrical drum 6.

At the end portions of the support shafts 58 protruding to the upper portions of the support block 57, there is provided a stopping member 59 provided in such a manner that the stopping member 59 connects the support shafts 58. A compression spring 60 is wound around each support shaft 58 between the support block 57 and the stopping member 59. The cam member 56 is urged by a resilient urging force of the compression spring 60 at all times so that the cam member 56 can be moved to a position (upward) at which the cam member 56 is separate from the rotary cylindrical drum 6.

The cam member 56, which is slidably arranged and urged to a position where the cam member 56 is separate from the rotary cylindrical drum 6, is moved by a driving device 61 so that it can come close to the rotary cylindrical drum 6. The driving device 61 includes: a rotary shaft 62 pivotally disposed between the support plates 55; an elevating cam 63 which is fixed to the rotary shaft 62 and capable of coming into contact with the upside of the cam member 56; and a drive motor 65 having a drive gear 64*b* meshed with the driven gear 64*a* fixed to the rotary shaft 62 so that the rotary shaft 62 can be driven.

As shown in FIG. 5, the elevating cam 63 always comes into contact with an upper surface of the cam member 56 which is urged and moved upward by the compression coil spring 60. This elevating cam 63 is rotated by the drive motor 65 together with the rotary shaft 62. Therefore, this elevating cam 63 lowers the cam member 56 toward the rotary cylindrical drum 6 by the circumferential profile coming into contact with the cam member 56.

As described above, the cam member 56 comes close to the rotary cylindrical drum 6 by the driving device 61. A lower surface of the cam member 56 comes into contact with the first contact piece 48 of the clamping plate 44 and the second contact piece 51 of the flapper member 49. On the lower surface of this cam member 56, there are provided a cam groove 56*a* for pressing the first contact piece 48, which moves by the rotation of the rotary cylindrical drum 6, to the rotary cylindrical drum 6 side, and a cam groove 56*b* for pressing the second contact piece 51 to the rotary cylindrical drum 6 side.

The cam groove 56*a* is formed into a profile shown by the one-dotted chain line and broken line in FIG. 5 which are drawn along the outer circumferential surface of the rotary cylindrical drum 6. This cam groove 56*a* presses the first contact piece 48, and the clamping plate 44 is separated from the magnet plate 47 in a predetermined timed relation so that the clamping plate 44 can be put into an open state, and further this cam groove 56*a* adjusts an open angle of the clamping plate 44 in the open state.

The cam groove 56*b* is formed into a profile shown by the solid line and broken line in FIG. 5 which are drawn along the outer circumferential surface of the rotary cylindrical drum 6. This cam groove 56*b* presses the second contact piece 51, and the flapper plate 49 is separated from the magnet plate 47 in a predetermined timed relation so that the flapper plate 49 can be put into an open state, and further this cam groove 56*b* adjusts an open angle of the flapper plate 49 in the open state.

In this connection, since the cam groove 56*b* comes into contact with the second contact piece 51 of the flapper member 49, the cam groove 56*b* is formed only in the cam member 56 (56A) shown on the upper side in FIG. 4 located at the upper position of the second contact piece 51. That is, only the cam groove 56*a* is formed in the cam member 56 (56B) shown on the lower side of FIG. 4.

In this case, the second contacting member 51 may be arranged not only at one end portion of the flapper member 49 in the longitudinal direction but also at both end portions of the flapper member 49 in the longitudinal direction. In this case, the cam groove 56*b* is also provided in the cam member 56 (56B) shown on the lower side of FIG. 4.

Movements of the above stencil sheet retaining device will be explained as follows.

First, referring to the side views of FIGS. 6 to 9 showing a movement of discharging a stencil sheet, the movement of discharging the stencil sheet M which has been set on the rotary cylindrical drum 6 will be explained below.

The stencil sheet M, the end portion of which is retained by the retaining section 40, is wound around and set on the outer circumferential surface of the rotary cylindrical drum 6. Under the above condition, printing is conducted, and then the stencil sheet M, which has already been used, is peeled and taken off from the outer circumferential surface of the rotary cylindrical drum 6. A position of the retaining section 40 moved by the rotation of the rotary cylindrical drum 6 is detected by a detection device (not shown) for detecting the rotary position of the rotary cylindrical drum 6.

Figure 6:
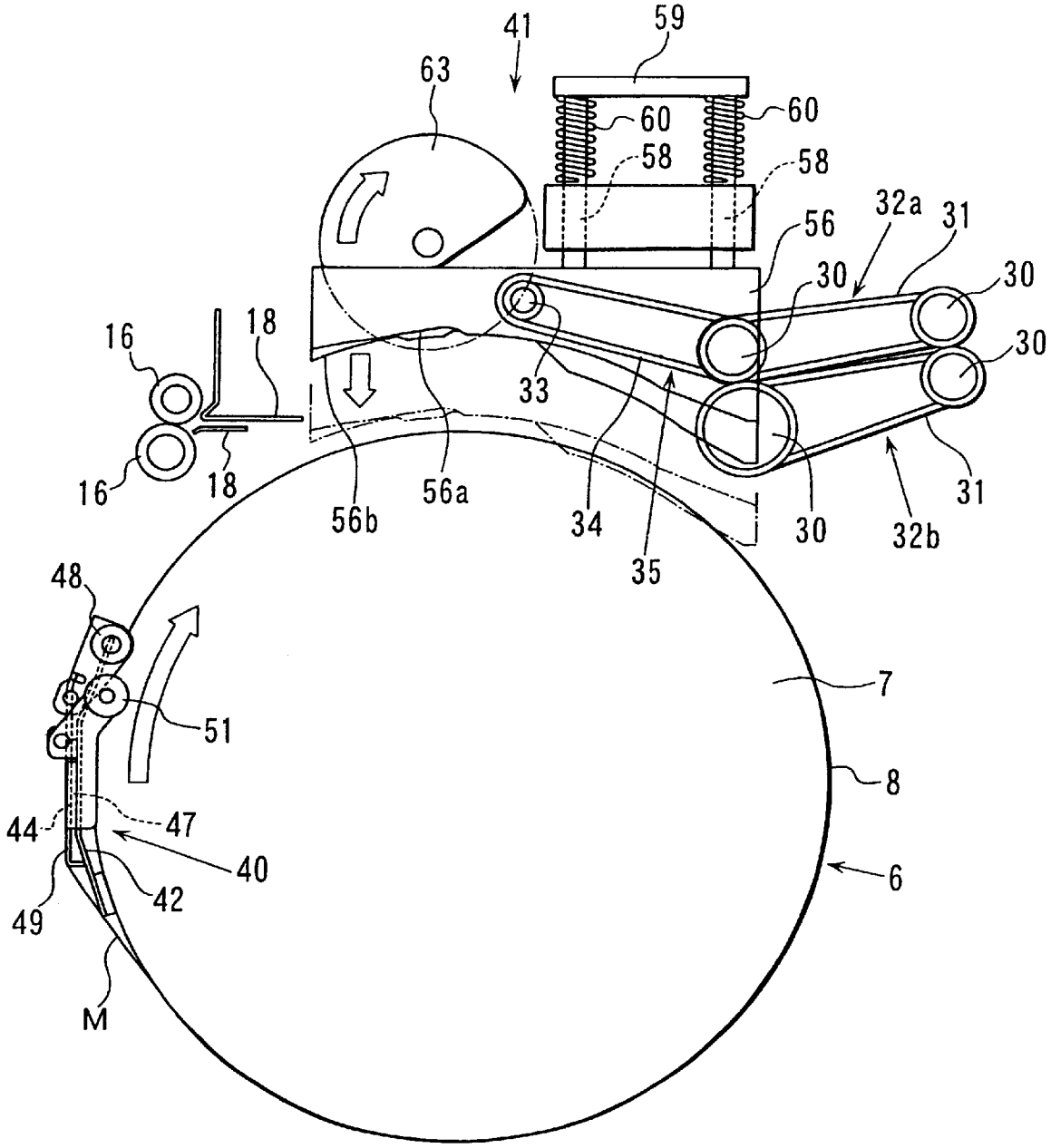
FIG. 6 is a side view showing a stencil sheet discharging motion.

As shown in FIG. 6, when the retaining section 40 arrives at a stencil sheet discharging position (position which is close to the stencil discharging section 5 and at which the drive section 41 is arranged), the drive motor 65 of the driving device 61 in the drive section 41 is driven, so that the elevating cam 63 is rotated and the cam member 56 is lowered in such a manner that the cam member 56 comes close to the rotary cylindrical drum 6.

Figure 7:
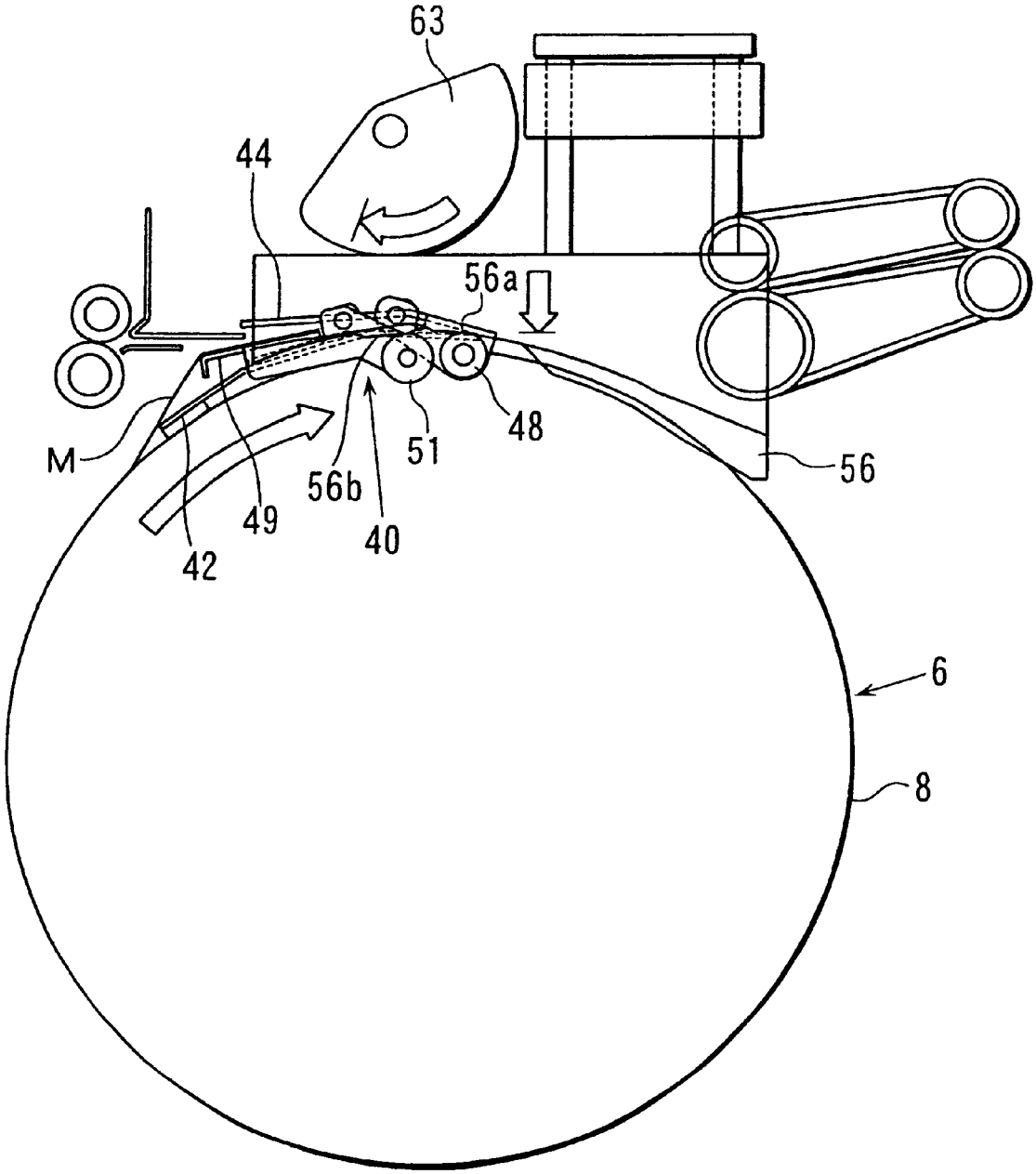
FIG. 7 is a side view showing a stencil sheet discharging motion.

Next, as shown in FIG. 7, the elevating cam 63 is stopped under the condition that the cam member 56 is lowered. Under the above condition, the retaining section 40 moving according to the rotation of the rotary cylindrical drum 6 comes close to the cam member 56. Due to the above movement, the first contact piece 48 of the clamping plate 44 comes into contact with the cam groove 56*a* of the cam member 56, and the second contact piece 51 of the flapper member 49 comes into contact with the cam groove 56*b* of the cam member 56. Since the first contact piece 48 is pressed by the cam groove 56*a*, the clamping plate 44 is opened, so that the end portion of the stencil sheet M interposed between the clamping plate 44 and the magnet plate 47 can be released. In this case, the rotary cylindrical drum 6 continues rotating without being stopped.

Figure 8:
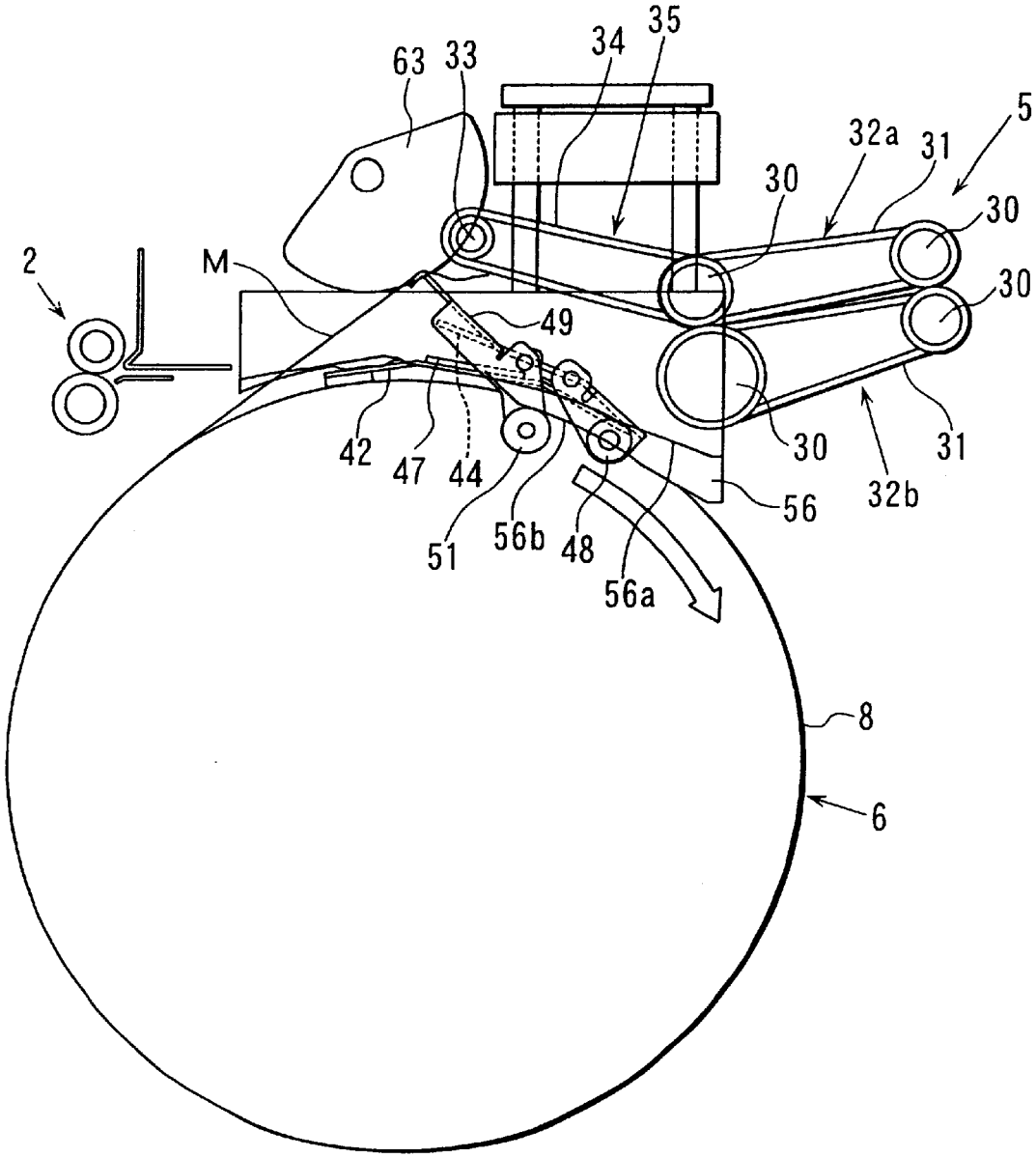
FIG. 8 is a side view showing a stencil sheet discharging motion.

Next, as shown in FIG. 8, under the condition that the cam member 56 is lowered and stopped and also the rotary cylindrical drum 6 is rotating, the first contact piece 48 comes into contact with the cam groove 56*a* of the cam member 56. Therefore, the clamping plate 44 is opened.

As shown in FIG. 8, when the cam member 56 is lowered and stopped and also the rotary cylindrical drum 6 is rotating, the second contact piece 51 comes into contact with the cam groove 56*b*. Therefore, the flapper member 49 is put into an open state in which the oscillating end section of the flapper member 49 is located at an upper position of the oscillating end section of the clamping plate 44. As described above, the flapper member 49 is arranged on the reverse side of the end portion of the stencil sheet M retained by the clamping plate 44. Due to the foregoing, the flapper member 49 draws out the end portion of the stencil sheet M from between the clamping plate 44, which is in an open state, and the magnet plate 47, and lifts the end portion of the stencil sheet M so that it can be separated from the outer circumferential surface of the rotary cylindrical drum 6.

Figure 9:
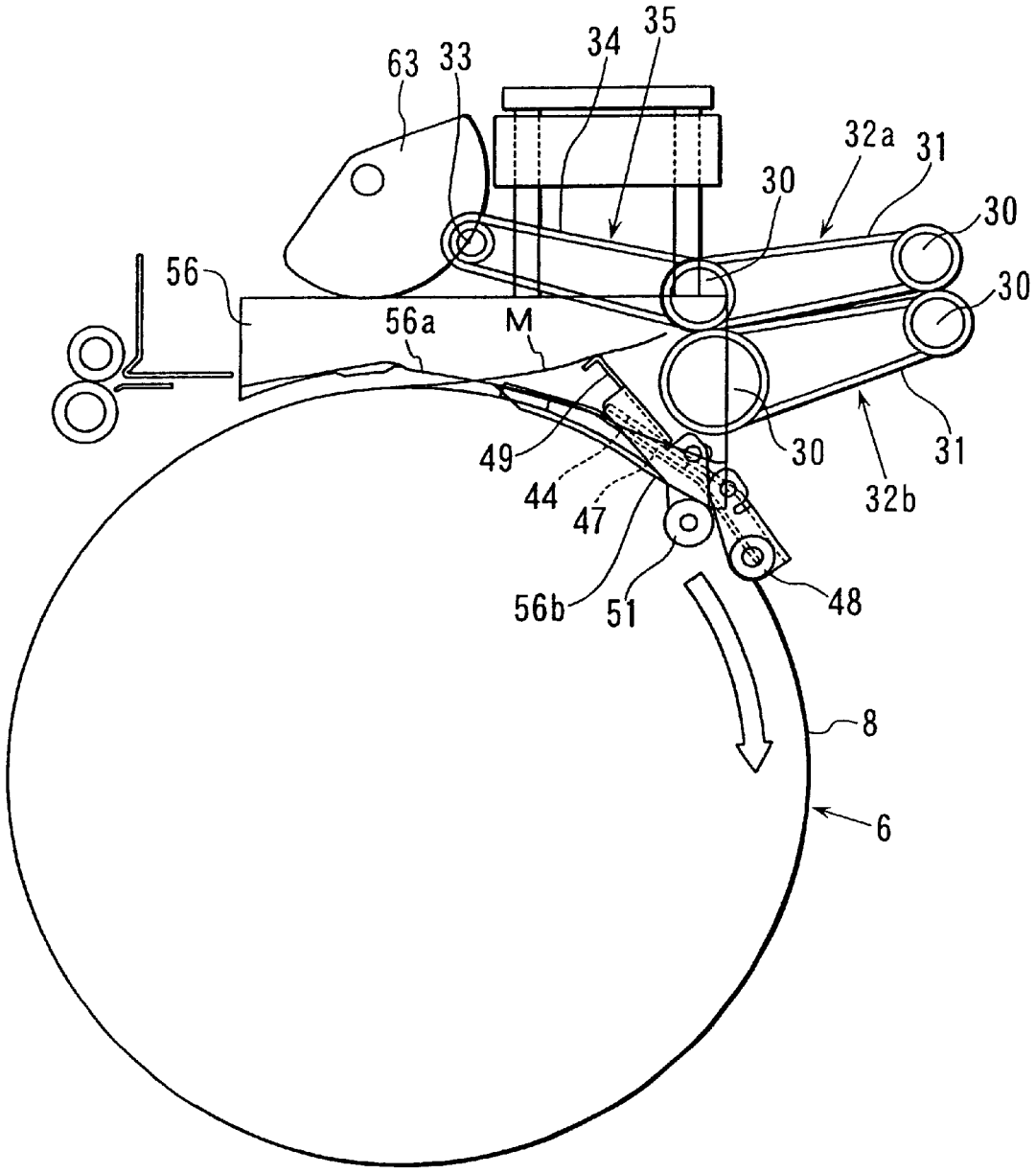
FIG. 9 is a side view showing a stencil sheet discharging motion.

Next, as shown in FIG. 9, when the cam member 56 is lowered and the rotary cylindrical drum 6 is rotating, the clamping plate 44 is separated from the cam groove 56*a* of the cam member 56. In this case, as shown in FIGS. 7 and 8, the open angle of the clamping plate 44 in the case of an open state is the same as the range in which an attraction force of the magnet plate 47 has an influence. Therefore, the clamping plate 44 is put into a closed state again in which the clamping plate 44 is attracted by the magnet plate 47.

As shown in FIG. 9, when the cam member 56 is lowered and stopped and the rotary cylindrical drum 6 is rotating, the open angle of the flapper member 49 is set at an angle so that the flapper member 49 can not come into contact with the belt 34 of the delivery section 35 of the stencil discharging section 5 according to the profile of the cam groove 56*a*, and the open state is continued. In this case, the oscillating end section of the flapper member 49 does not come into contact with the belt 34 of the delivery section 35, however, the oscillating end section of the flapper member 49 comes close to the belt 34 of the delivery section 35. Due to the foregoing, the end portion of the stencil sheet M lifted up by the oscillating end section of the flapper member 49 is capable of coming into contact with the belt 34 of the delivery section 35 and delivered into between the upper 32*a* and the lower conveying section 32*b*. Since the oscillating end section of the flapper member 49 is bent as described above, it is possible for the flapper member 49 to appropriately lift up the end portion of the stencil sheet M.

Figure 10:
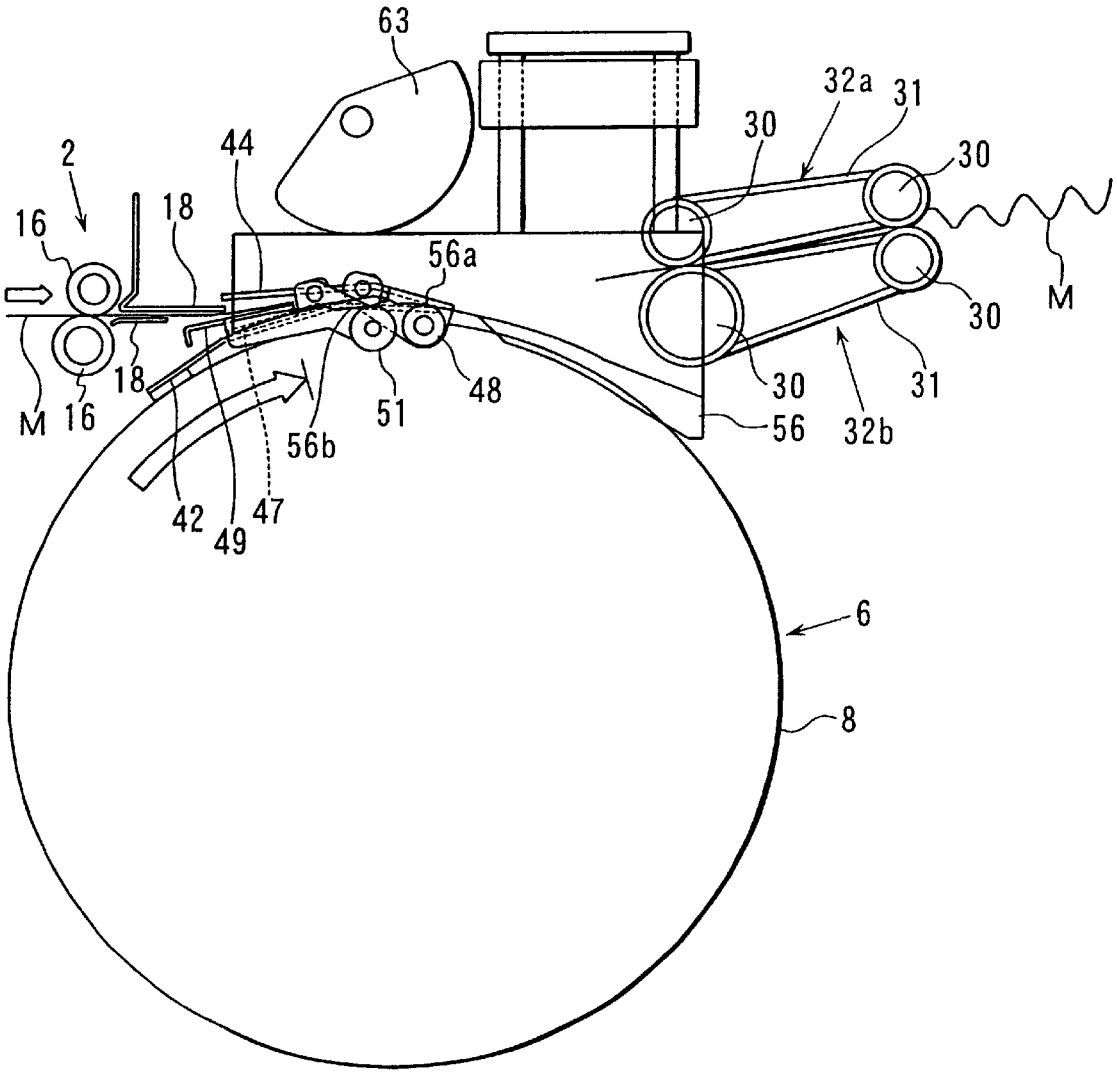
FIG. 10 is a side view showing a stencil sheet setting motion.

The end portion of the stencil sheet M introduced into between the upper 32*a* and the lower conveying section 32*b* is conveyed into the stencil discharged container 36 by the upper 32*a* and the lower conveying section 32*b* as shown in FIG. 10. The stencil sheet M conveyed into the stencil discharged container 36 is compressed by the compressing plate 37 in the stencil discharged container 36 and then scrapped.

In this connection, as shown in FIG. 10, when the stencil sheet M is conveyed onto the stencil discharged container 36 side, the rotary cylindrical drum 6 is rotating and starts the following movement in which the next stencil sheet M is set.

In this connection, in the above stencil sheet discharging motion, immediately before the above stencil sheet discharging motion, that is, when the rotary position of the rotary cylindrical drum 6 in the case of completion of the last printing is set at a position which is very close to a position where the first 48 and the second contact piece 51 can be contacted with the cam grooves 56*a*, 56*b* of the cam member 56, it becomes possible to reduce a period of time necessary for the stencil sheet discharging motion.

Figure 11:
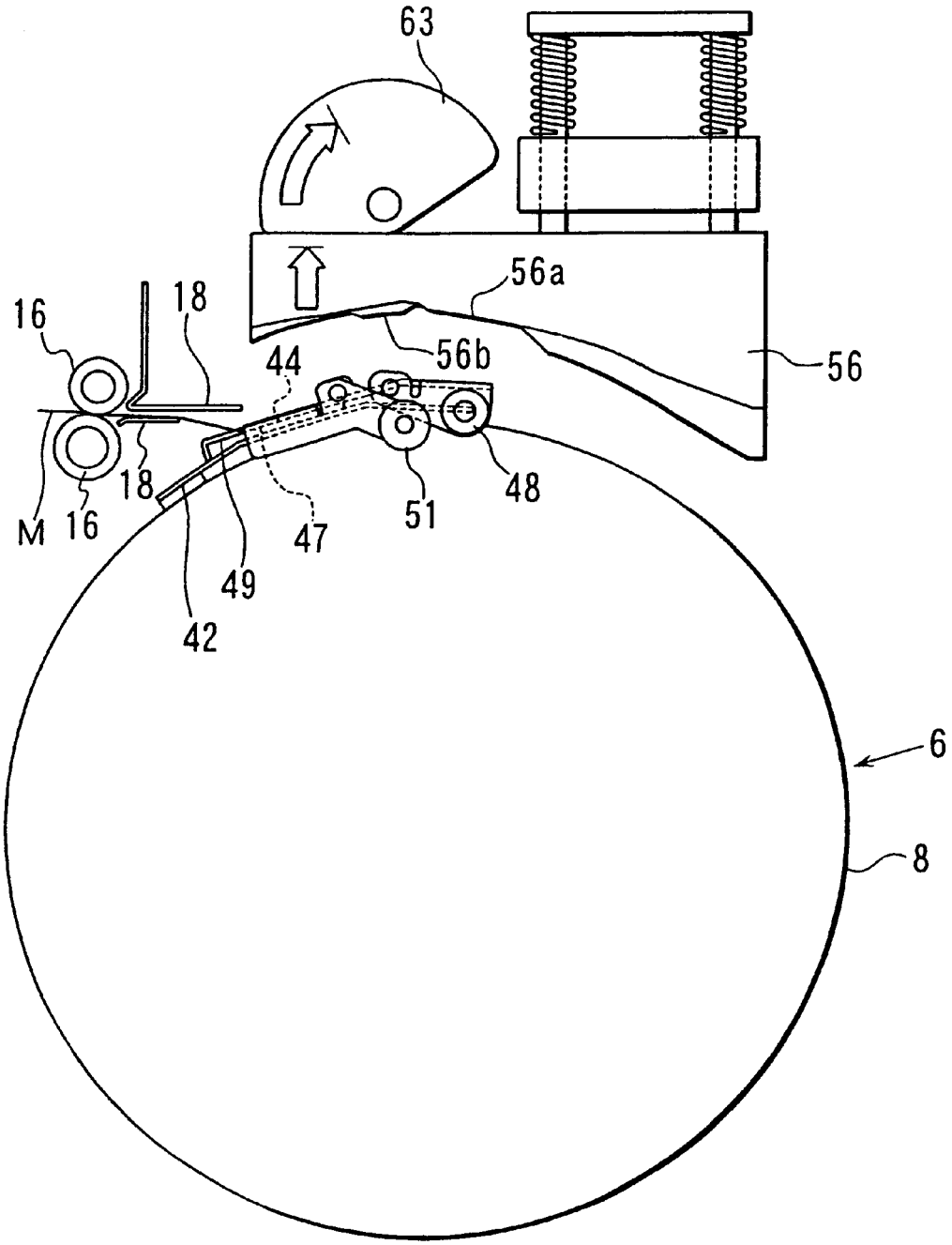
FIG. 11 is a side view showing a stencil sheet setting motion.
Figure 12:
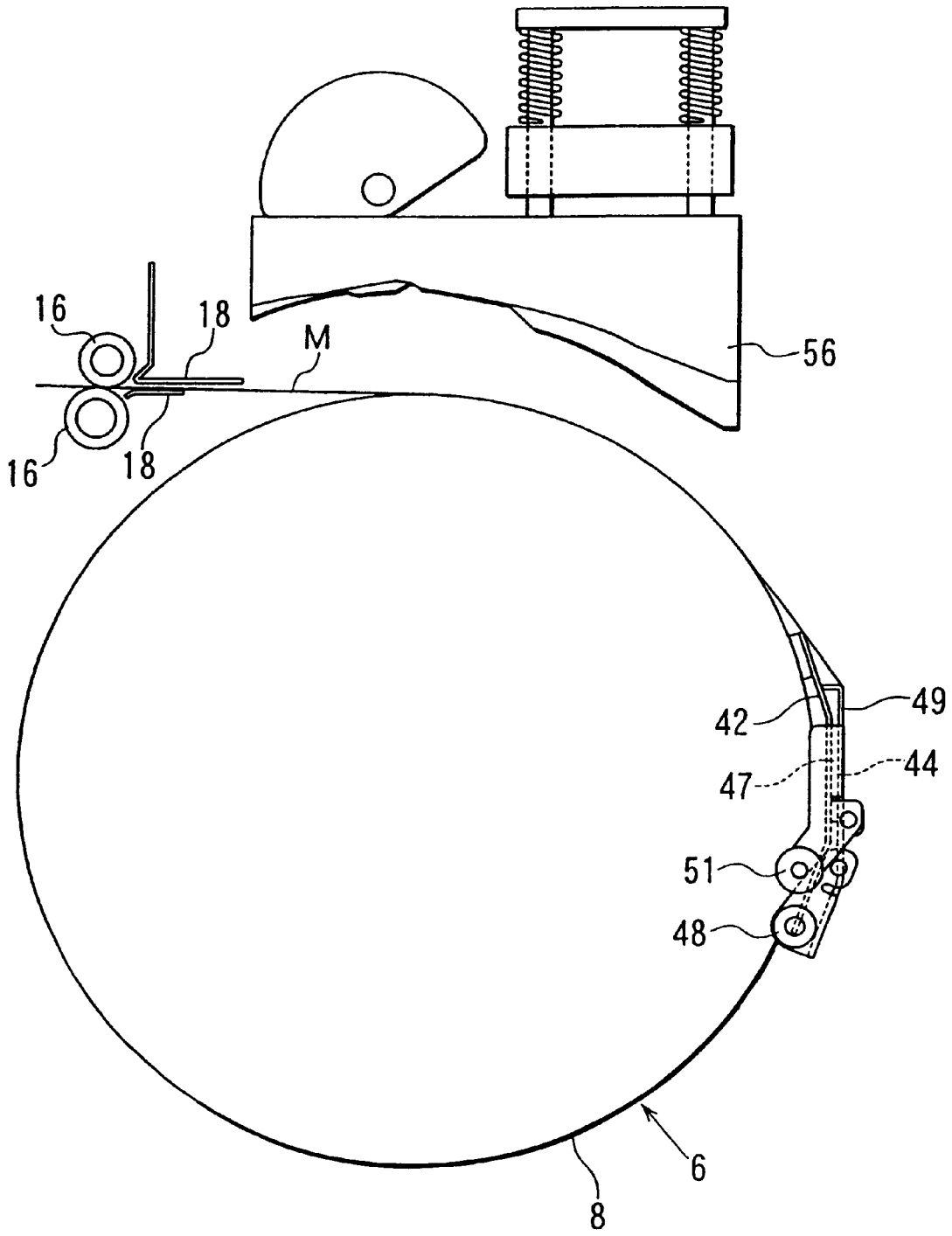
FIG. 12 is a side view showing a stencil sheet setting motion.

Next, referring to the side views of FIGS. 10 to 12 showing a stencil sheet setting motion, the stencil sheet setting motion by which the stencil sheet M is set on the rotary cylindrical drum 6 will be explained below.

When the stencil sheet M is set on the rotary cylindrical drum 6, the rotary cylindrical drum 6 stops rotating at a predetermined position shown in FIG. 10. This predetermined position is detected by a detection device (not shown) for detecting a rotary position of the rotary cylindrical drum 6.

As shown in FIG. 10, when the rotary cylindrical drum 6 is stopped at the predetermined position, the cam member 56 is lowered and stopped, so that the successive motion for discharging the stencil sheet M as mentioned above can be continued. Under the above condition, the first contact piece 48 of the clamping plate 44 comes into contact with the cam groove 56*a* of the cam member 56, and the second contact piece 51 of the flapper member 49 comes into contact with the cam groove 56*b* of the cam member 56. Then, the first contact piece 48 is pressed by the cam groove 56*a*, and the clamping plate 44 is opened. Further, the second contact piece 51 is pressed by the cam groove 56*b*, and the flapper member 49 is opened.

In this case, the open angle of the clamping plate 44 is set by the profile of the cam groove 56*a* so that the oscillating end portion of the clamping plate 44 can be located at an upper position of the upper guide plate 18 of the stencil making section 2. The open angle of the flapper member 49 is set by the profile of the cam groove 56*b* so that the upper surface of the flapper member 49 can be lower than the lower guide plate 18 and come along the lower surface of the upper guide plate 18.

In the stencil making section 2, the stencil sheet M is stored in the stencil sheet roll section 13 in the form of a roll. Therefore, an end portion of the stencil sheet M, which has been formed, is curled upward in FIG. 10. That is, while the end portion of the stencil sheet M is curled upward and coming into contact with the lower surface of the upper guide plate 18, the stencil sheet M is conveyed and delivered to the clamping plate 44 located on the upper side of the upper guide plate 18. Since the flapper member 49 comes along the lower surface of the upper guide plate 18, it is possible to suppress the curling portion at the end of the stencil sheet M. Therefore, the end portion of the stencil sheet M conveyed from the stencil making section 2 is not affected by the curling profile and is introduced into between the clamping plate 44 and the magnet plate 47 and onto the upper side of the flapper member 49.

In this connection, a quantity of feed (length of feed) of the end portion of the stencil sheet M, which is fed to the clamping plate 44 side, can be determined without almost causing any error, because the stencil detecting device 19 has detected the end portion of the stencil sheet M in the stencil making section 2 and the stopping position of the rotary cylindrical drum 6 has been detected by the above detection device (not shown). The thus determined quantity of feed may be executed by the stencil feeding roller 16.

Next, as shown in FIG. 11, after the end portion of the stencil sheet M has been conveyed to between the clamping plate 44 and the magnet plate 47, the drive motor 65 of the driving device 61 of the drive section 41 is driven so as to rotate the elevating cam 63, and the cam member 56 is lifted up so that it can be separated from the rotary cylindrical drum 6. Due to the foregoing, the cam groove 56*a* of the cam member 56 is separated from the first contact piece 48 of the clamping plate 44, and the cam groove 56*b* of the cam member 56 is separated from the second contact piece 51. Then, the clamping plate 44 and flapper member 49 are attracted by the magnet plate 47 and put into a closed state. That is, the clamping plate 44 retains the end portion of the stencil sheet M in such a manner that the end portion of the stencil sheet M is interposed between the clamping plate 44 and the magnet plate 47. The flapper member 49 is located on the reverse side of the stencil sheet M retained by the clamping plate 44.

Next, as shown in FIG. 12, after the cam member 56 has been lifted up, the rotary cylindrical drum 6 is rotated, so that the stencil sheet M can be wound around the outer circumferential surface of the rotary cylindrical drum 6.

Accordingly, the stencil sheet retaining device constructed as described above comprises a clamping plate 44 for retaining the stencil sheet M and a flapper member 49 for drawing out the end portion of the stencil sheet M from the clamping plate 44 in the case of discharging the stencil sheet. The first contact piece 48 of the clamping plate 44 and the second contact piece 51 of the flapper member 49 are pressed by the profiles of the cam grooves 56*a* and 56*b* provided in the cam member 56 which can be driven so that the cam member 56 can be contacted with and separated from the rotary cylindrical drum 6, so that the clamping plate 44 and the flapper member 49 can be put into an open and a closed state and further the releasing angles of the clamping plate 44 and the flapper member 49 can be adjusted.

Therefore, in the case of discharging a stencil sheet, it is possible to conduct a stencil sheet discharging motion without stopping the rotation of the rotary cylindrical drum 6. Due to the foregoing, it is possible to reduce a period of time of first printing from the start button pushing motion to start a stencil printing machine conducted by an operator to obtaining the first print after the stencil sheet M has been formed, set on the rotary cylindrical drum and discharged.

In the case of discharging the stencil sheet M, the end portion of the stencil sheet M is appropriately drawn out from the clamping plate 44 when the open angle of the flapper member 49 is adjusted by the cam groove 56*b*, and at the same time the end portion of the stencil sheet M is delivered to the stencil discharging section 5 by utilizing the oscillating end section of the flapper member 49. Due to the foregoing, it is possible to positively conduct a stencil sheet discharging motion without utilizing a mechanism, which has been required in the related art, for peeling off the stencil sheet M from the outer circumferential surface of the rotary cylindrical drum 6.

In the case of setting a stencil sheet on the rotary cylindrical drum, the open angles of the clamping plate 44 and flapper plate 49 are adjusted according to the cam grooves 56*a*, 56*b* so that the open angles formed by the clamping plate 44 and flapper member 49 can be decreased, and at the same time the positional relations of the clamping plate 44 and flapper plate 49 with the upper and lower guide plates 18 on the stencil making section 2 side are appropriately adjusted, so that the end portion of the conveyed stencil sheet M can be introduced according to the state. Due to the foregoing, there is no possibility that the end portion of the stencil sheet M is held being folded. Further, there is no possibility that wrinkles are caused on the stencil sheet M which has been set on the rotary cylindrical drum 6. Furthermore, there is no possibility that the stencil sheet M is set on the rotary cylindrical drum 6 being skewed.

A drive force to separate the clamping plate 44 and the flapper member 49 from the magnet plate 47 is generated by the torque of the rotary cylindrical drum 6 with respect to the fixed cam member 56. Accordingly, it is possible to obtain a sufficiently strong drive force to separate the clamping plate 44 and flapper member 49 resisting the attraction force of the magnet plate 47.

The source of driving the cam member 56, which is related to the opening and closing movements of the clamping plate 44 and flapper plate 49, is only the drive motor. Further, the capacity of this drive motor may be small so that it can lower the cam member 56. Therefore, the entire dimension of the stencil printing machine can be reduced.

As described above, in the stencil sheet retaining device according to the first aspect of the present invention, a clamping plate for retaining an end portion of a stencil sheet, and a flapper member for drawing out the end portion of the stencil sheet from the clamping plate side in the case of discharging the stencil sheet are provided. Further, a first contact piece attached to the clamping plate and a second contact piece attached to the flapper member are pressed by the profiles of the cam grooves of a movable cam member according to the rotary position of the rotary cylindrical drum so that the clamping plate and the flapper member can be opened and the open angles of the clamping plate and the flapper member can be adjusted.

Due to the above structure, it is possible to conduct a discharging motion for discharging a stencil sheet while the rotary cylindrical drum is rotating. It is also possible to reduce a period of time of first printing from the start button pushing motion to start a stencil printing machine conducted by an operator to obtaining the first print after a stencil sheet has been formed, set on the rotary cylindrical drum and discharged.

A drive force to separate the clamping plate and the flapper member from the magnet plate is generated by the torque of the rotary cylindrical drum which causes the first and the second contact piece to come into contact with the cam grooves of the cam member. Accordingly, it is possible to obtain a sufficiently strong drive force to separate the clamping plate and flapper member resisting the attraction force of the magnet plate.

Concerning the driving device for opening and closing the clamping plate and flapper member, it is sufficient that the capacity of the driving device is to move the cam member. Therefore, for example, it is possible to adopt a small motor. Therefore, the entire dimension of the stencil printing machine can be reduced.

In the stencil sheet retaining device according to the second aspect of the present invention, in case of discharging a stencil sheet, an end portion of the stencil sheet is drawn out from the clamping plate side by adjusting an open angle of the flapper member which is made to flap by the cam groove of the cam member according to the rotation of the rotary cylindrical drum, and the end portion of the stencil sheet can be delivered to the stencil discharging section by utilizing the oscillating end section of the flapper member which is in an open state. Due to the foregoing, it is possible to positively conduct a stencil sheet discharging motion without utilizing a mechanism, which has been required in the related art, for peeling off a stencil sheet from the outer circumferential surface of the rotary cylindrical drum.

In the stencil sheet retaining device according to the third aspect of the present invention, in case of setting a stencil sheet on the rotary cylindrical drum, by adjusting the open angles of the clamping plate (44) and flapper member (49) by the cam grooves of the cam member according to the rotation of the rotary cylindrical drum, the end portion of a stencil sheet conveyed from the stencil making section side, in which the stencil sheet is formed, can be introduced on the upper surface of the flapper member. Due to the foregoing, there is no possibility that the end portion of a stencil sheet is held being folded. Further, there is no possibility that wrinkles are caused on the stencil sheet which has been set on the rotary cylindrical drum. Furthermore, there is no possibility that the stencil sheet is set on the rotary cylindrical drum being skewed.

What is claimed is:

1. A stencil sheet retaining device for holding an end portion of a stencil sheet so that the stencil sheet, which has already been subjected to a stencil-making process, is wound on an outer circumferential surface of a rotary cylindrical drum rotating around an axis thereof, the stencil sheet retaining device comprising:

a clamping plate and a first rotary shaft, said clamping plate pivotally disposed through said first rotary shaft arranged in parallel with the axis of the rotary cylindrical drum with respect to the outer circumferential surface of the rotary cylindrical drum, the clamping plate having an oscillating end portion adapted to be attracted by a magnet plate arranged at a predetermined position on an outer circumferential surface side of the rotary cylindrical drum so as to be adapted to hold the end portion of the stencil sheet between the clamping plate and the magnet plate;

a flapper member and a second rotary shaft, said flapper member pivotally disposed through said second rotary shaft arranged in parallel with the first rotary shaft with respect to the outer circumferential surface of the rotary cylindrical drum, the flapper member has an oscillating end portion, wherein the end portion of the stencil sheet adapted to be held by the clamping plate can be located on an upper side on which the oscillating end portion of the flapper member is adapted to be attracted to the magnet plate;

a first contact piece disposed through the first rotary shaft at an end portion of the clamping plate opposite to the oscillating end portion of the clamping plate;

a second contact piece disposed through the second rotary shaft at an end portion of the flapper member opposite to the oscillating end portion of the flapper member;

a cam member having cam grooves movably arranged at a position where the cam member can be contacted with and separated from the first and second contact pieces, the cam member coming into contact with and pressing the first and the second contact piece according to a rotary position of the rotary cylindrical drum, so that the clamping plate and the flapper member can be put into open states in which the clamping plate and the flapper member can be respectively separated from the magnet plate, and so that the open states, in which the clamping plate and the flapper member are respectively open, can be respectively set at a predetermined timed relation and an open angle; and a driving device which moves the cam member to positions at which the cam member is contacted with and separated from the first and second contact pieces.

2. The stencil sheet retaining device of claim 1, wherein the flapper member is opened in accordance with rotation of the rotary cylindrical drum due to profiles of the cam grooves of the cam member so as to adjust the open angle of the flapper member, and wherein the end portion of the stencil sheet is drawn out from the clamping plate side which is put into the open state, and the stencil sheet is adapted to be delivered to a stencil discharging section for discharging the stencil sheet by lifting up the end portion of the stencil sheet so that the end portion of the stencil sheet can be separated form the outer circumferential surface of the rotary cylindrical drum.

3. The stencil sheet retaining device of claim 2, wherein the clamping plate is opened in accordance with rotation of the rotary cylindrical drum due to profiles of the cam grooves of the cam member so as to adjust the open angle of the clamping plate, and wherein the end portion of the stencil sheet conveyed from a stencil making section for making the stencil sheet is adapted to be guided between the clamping plate and the upper side of the flapper member.

4. The stencil sheet retaining device of claim 1, wherein the clamping plate is opened in accordance with rotation of the rotary cylindrical drum due to profiles of the cam grooves of the cam member so as to adjust the open angle of the clamping plate, and wherein the end portion of the stencil sheet conveyed form a stencil making section for making the stencil sheet is adapted to be guided between the clamping plate and the upper side of the flapper member which is opened in accordance with rotation of the rotary cylindrical drum due to profiles of the cam grooves of the cam member so as to adjust the open angle of the flapper member.

* * * * *